US006862754B1

(12) United States Patent
DeMarco

(10) Patent No.: US 6,862,754 B1
(45) Date of Patent: Mar. 8, 2005

(54) DUAL PHASE FLUSH URINAL

(75) Inventor: Peter V. DeMarco, Dayton, NJ (US)

(73) Assignee: American Standard International Inc., New York, NY (US)

( * ) Notice: Subject to any disclaimer, the term of this patent is extended or adjusted under 35 U.S.C. 154(b) by 1 day.

(21) Appl. No.: 10/646,616

(22) Filed: Aug. 22, 2003

(51) Int. Cl.[7] ..... E03D 13/00
(52) U.S. Cl. ..... 4/304; 4/302
(58) Field of Search ..... 4/301–305, 310

(56) References Cited

U.S. PATENT DOCUMENTS

| | | | | |
|---|---|---|---|---|
| 4,310,934 | A | 1/1982 | Hennessy et al. | |
| 4,692,951 | A * | 9/1987 | Taki et al. | 4/664 |
| 4,967,425 | A * | 11/1990 | Kawamura et al. | 4/619 |
| 5,386,596 | A | 2/1995 | Hennessy | |
| 5,398,348 | A * | 3/1995 | Tashiro et al. | 4/304 |
| 5,711,037 | A | 1/1998 | Reichardt et al. | |
| 6,053,197 | A | 4/2000 | Gorges | |
| 6,425,411 | B1 | 7/2002 | Gorges | |
| 2002/0038474 | A1 | 4/2002 | Atwill | |
| 2002/0069913 | A1 | 6/2002 | Gorges et al. | |

* cited by examiner

*Primary Examiner*—Gregory L. Huson
*Assistant Examiner*—Huyen Le

(57) ABSTRACT

A dual-phase flush urinal that maintains itself in a sufficiently sanitary condition with minimal water consumption. The urinal includes a piece of chinaware having a rear wall with a pair of sidewalls depending normally outward therefrom. A bottom extent of the sidewalls terminates in a curved bowl portion having a fluid well and a water drain therewithin. The sidewalls and rear wall together define a containment area in which an atmospheric vacuum breaker and valve means are disposed. The valve means is in electrical communication with a sensor that detects the presence of a user and has a first fluid discharge port in fluid communication with the bowl portion and a second fluid discharge port. Upon detection of the user, the sensor transmits a first signal to the valve means to initiate a first water exchange phase of the flush cycle. The first fluid discharge port provides water along an elongate channel to remove waste from the bowl portion. After a preprogrammed delay, the sensor transmits a second signal to the valve means to initiate a subsequent, time-delayed wall-scouring phase of the flush cycle. The second fluid discharge port provides water through a urinal spreader to ensure rinsing of the back surface subsequent to actuation of the jet. The valve means operates according to a desired preprogrammed schedule to ensure delivery of adequate water to the urinal jet and expulsion of waste from the urinal to an exterior sewage system.

20 Claims, 3 Drawing Sheets

DUAL PHASE FLUSH URINAL

FIELD OF THE INVENTION

The present invention is directed to sanitaryware that consumes less water than conventional devices yet sustains sufficient hygiene standards. More particularly, the present invention is directed to a urinal that implements valve means having a pair of fluid discharge ports to substantially reduce the amount of water necessary to maintain the urinal in a clean and sanitary condition. In this configuration, the present invention urinal desirably effects water exchange and wall scouring functions on a time delay basis, thereby substantially reducing the amount of water consumed without sacrificing cleanliness.

BACKGROUND OF THE INVENTION

The excessive consumption of potable water remains a dilemma for water agencies, commercial building owners, homeowners, residents and sanitaryware manufacturers. An increasing global population has negatively affected the amount and quality of suitable water. Effluents in water supplies and increasing air pollutants have drastically altered fresh water supplies. The propensity for drought in previously fertile geographies has reinforced global concern over responsible water consumption. The drive for optimum water conservation strategies, however, typically yields to the overriding need to sustain a healthy population through the enactment and enforcement of plumbing codes and the installation of sanitary plumbing fixtures that are compliant therewith.

In an effort to execute water conservation strategies, many sanitaryware manufacturers have introduced a variety of low water and water-free urinals. Many low water urinals have strategically designed bowls and trapways that restrict elimination of water from the bowl during flushing (see, for example, U.S. Pat. Nos., 4,310,934 and 5,386,596). Many such designs still use an inordinate amount of water to complete a flush cycle, especially in consideration of contemporary water conservation efforts.

Waterless urinals are also available that consume no water at all. Such urinals often employ replaceable cartridges having means for entry and discharge and a sealant layer that prevents malodorous emissions from the drainage system yet allows flow of urine therethrough. Conventional waterless designs, however, do not scour a back wall surface and do not provide a water trap seal as required by plumbing codes in the United States and other jurisdictions. In addition, omission of the water trap seal in waterless fixtures necessarily omits replenishment of the trap seal after each use, thereby requiring frequent maintenance of the fixtures to maintain satisfactory cleanliness (such as the addition of a liquid medium to provide a seal between the liquid waste and the room, and periodic cartridge replacement). Examples of such devices are disclosed in U.S. Pat. Nos. 6,053,197, 6,425,411, 5,711,037 and US Patent Application Nos. 2002/0069913 and 2002/0038474.

It is therefore desirable to provide a urinal that substantially reduces consumption of potable water without comprising sanitation. Such a urinal uses minimal water amounts to achieve an effective flush and thereby maintain optimal fixture cleanliness.

SUMMARY OF THE INVENTION

It is an advantage of the present invention to provide an improved urinal that consumes substantially less water than conventional flush urinals.

It is also an advantage of the present invention to provide a urinal that overcomes the deficiencies of waterless urinals by providing a code-compliant fixture that periodically scours itself with water to ensure cleanliness and odor-free operation.

It is additionally an advantage of the present invention to provide a urinal that effects successive time-delayed water exchange and wall-scouring functions as separate phases of a complete flush cycle.

It is still further an advantage of the present invention to provide a urinal having the aforementioned advantages that can assume the appearance and proportions of conventional urinals for simple installation and maintenance in existing sanitary facilities.

In accordance with these and other advantages, the present invention is directed to a dual-phase flush urinal that maintains itself in a sufficiently sanitary condition with minimal water consumption. The urinal of the present invention includes a piece of chinaware that is in fluid communication with each of a pre-existing water supply and a waste removal conduit. The chinaware has a rear wall that is affixed to a parallel mounting surface and lies flush therewith. The rear wall has an upper extent that accommodates ingress of the water supply therein, and a bottom extent that accommodates egress of the waste conduit therefrom. Each of a pair of sidewalls depends normally outward from the rear wall and extends along the length thereof. The sidewalls and rear wall together delineate an interior portion and a containment area having an open ingress defined thereover. The containment area includes an atmospheric vacuum breaker and valve means in fluid communication with the water supply and in electrical communication with a sensor that detects the presence of a user. The valve means comprises a pair of first and second solenoid valves having respective first and second fluid discharge ports. Alternatively, the valve means comprises a single solenoid valve that has a pair of fluid discharge ports and operates in substantially the same manner as the first and second solenoid valves. A bottom extent of the sidewalls terminates in a curved bowl having a fluid well therewithin and a water drain within which a trap seal is maintained. The drain leads to a trapway of generally circular cross-section that directs waste to the waste conduit.

The sensor detects the presence of a user and transmits a signal to the first solenoid valve, thereby initiating valve operation. The first solenoid valve desirably activates after each use of the urinal. Upon activation, the first solenoid valve charges the urinal jet via a hollow channel defined along a urinal surface of the rear wall, thereby effecting the expulsion of waste from the urinal to an exterior sewage system. The second solenoid valve provides water through a urinal spreader and down the back surface of the fixture to ensure rinsing of the back surface subsequent to actuation of the jet. The second solenoid valve is programmed to activate after a desired temporal duration (for instance, a predetermined time subsequent to departure of a user from the vicinity of the urinal); after a predetermined number of uses; upon reaching a predetermined fluid volume in the bowl; or using any other parameter conducive to achieving a dual phase flush function. The single solenoid valve, provided with first and second fluid discharge ports therein, operates in substantially the same manner. The first sensor signal initiates the water exchange function by discharging water from the first fluid discharge port, and the subsequent second sensor signal initiates the wall scouring function by discharging water from the second fluid discharge port.

The present invention can assume the aesthetic appearance and size of conventional urinals so that the invention is readily installed in existing commercial or residential bathrooms. The present invention can therefore also coexist alongside conventional urinals or completely replace such urinals without changing the number of urinals or the layout of the entire bathroom.

Various other advantages and features of the present invention will become readily apparent from the following detailed description, and the inventive features will be particularly evident from the appended claims.

DETAILED DESCRIPTION OF THE PREFERRED EMBODIMENTS

Figure 1:
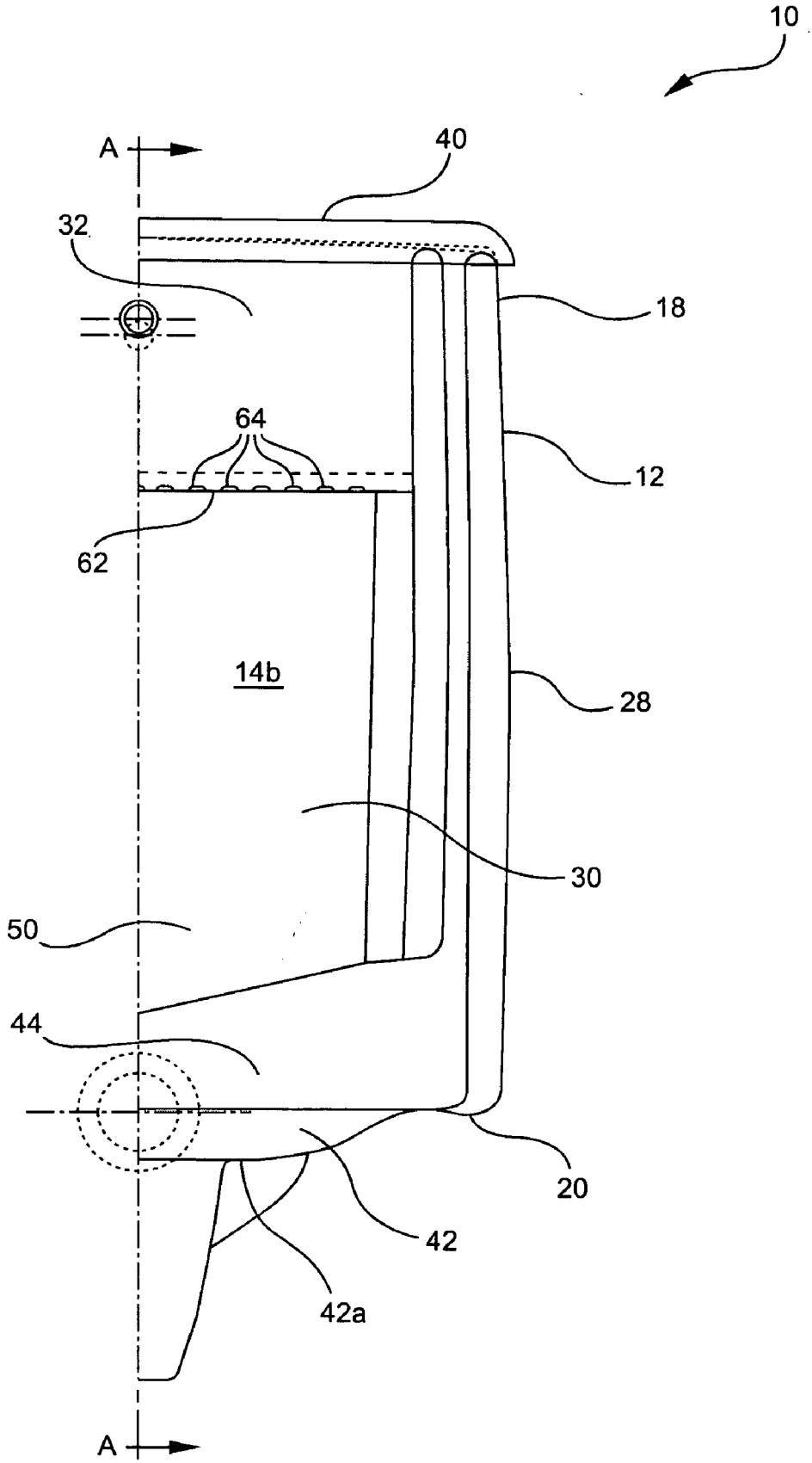
FIG. 1 shows a partial front perspective view of a urinal according to the present invention.

Now referring to the figures and particularly referring to FIG. 1, a urinal 10 of the present invention desirably comprises an integral chinaware fixture 12. Fixture 12 may also be fabricated from plastic, stainless steel or any other material that is amenable to practice of the present invention. Fixture 12 may have one or more treatments applied thereon to enhance the urinal's performance. Such treatments may include coatings or glazes having one or more of hydrophobic, hydrophilic, anti-microbial, antibacterial, biocidal, odor suppressing, anti-viral and algicidal properties. Such coatings are well known within the industry to promote the cleanliness of plumbing fixtures and deter the transmission of undesirable contagions thereby.

Fixture 12 includes a rear wall 14 (shown in FIG. 2) having a mounting surface 14*a* for mounting of the urinal to a support structure such as a wall and a urinal surface 14*b* facing the user that serves as a splash surface for the urinal. Intermediate mounting surface 14*a* and urinal surface 14*b* is elongate channel 16 defined therein, said channel extending from an upper extent 18 of rear wall 14 to a lower extent 20 of rear wall 14. Upper extent 18 accommodates ingress of a pre-existing water supply conduit 22 therein, and lower extent 20 accommodates egress of a new or pre-existing waste conduit 24 therefrom. Lower extent 20 may further accommodate outlet adapter 26 to ensure proper fluid communication between urinal 10 and waste conduit 24. Fixture 12 is shown with an example of the type of preexisting plumbing structure with which the present invention may be employed. Such plumbing structure is consistent with the design of conventional urinals and renders the present invention amenable to a plurality of pre-existing installation configurations that exist within residential and commercial structures, as will become apparent from the following description.

Figure 2:
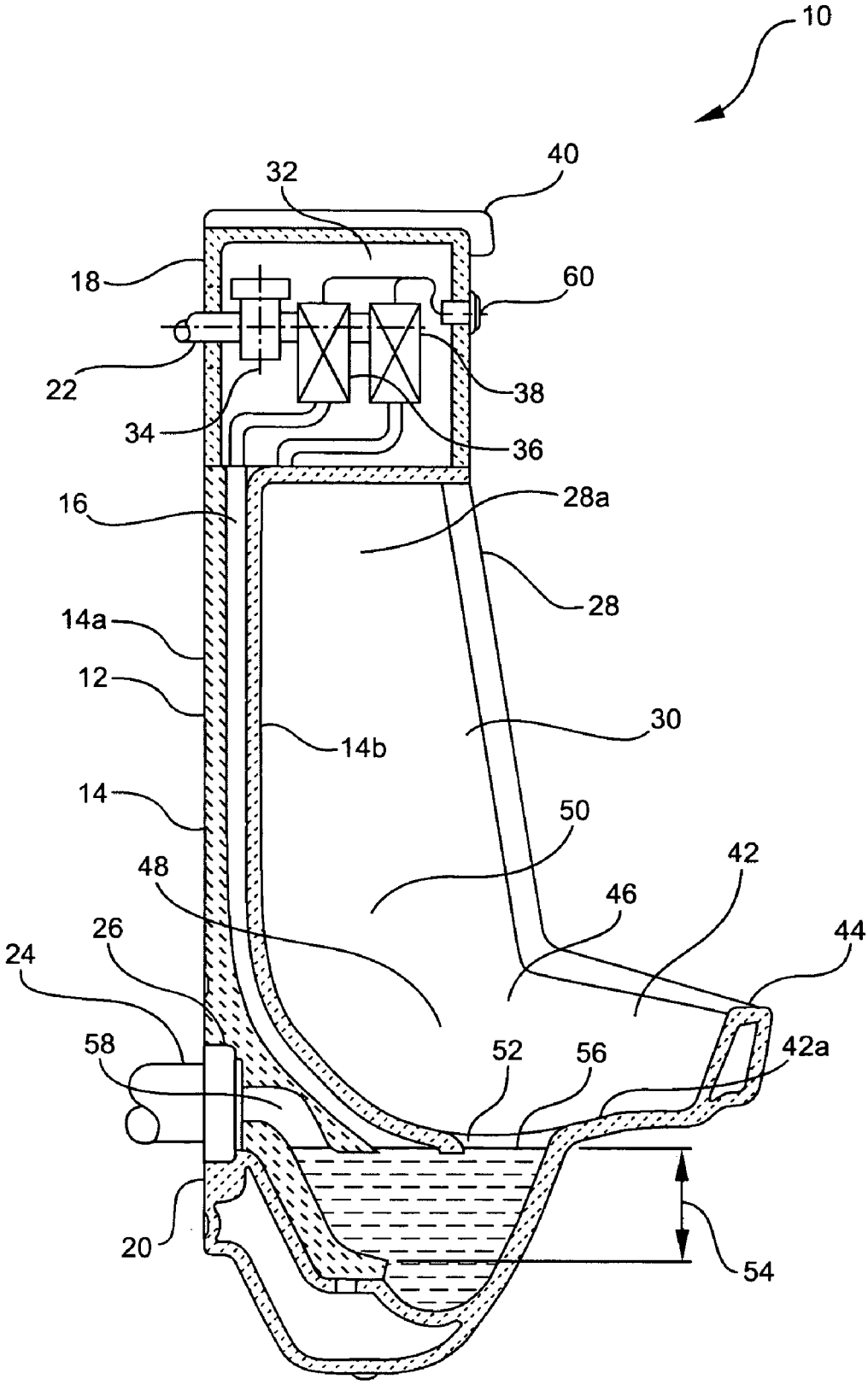
FIG. 2 shows a schematic cross-section of a preferred embodiment of the urinal according to the present invention taken along line A—A of FIG. 1.

Fixture 12 further includes two coextensive sidewalls 28 (only one of which is shown in FIGS. 1 and 2) that protrude normally outwardly from urinal surface 14*b*. Each sidewall 28 has a generally planar inner surface 28*a* that faces a like inner surface 28*a* generally parallel thereto and spaced therefrom. Urinal surface 14*b* and inner surfaces 28*a* together delineate an ingress 30 that provides access to an internally defined containment area 32 proximate upper extent 18. Containment area 32 accommodates placement of an atmospheric vacuum breaker (AVB) 34 and first and second solenoids 36 and 38 therein. AVB 34 prevents backsiphonage and may be selected from a variety of well-known and commercially available designs. Although AVB 34 is shown intermediate solenoid 36 and water supply 22, local codes generally dictate the location of installation of the vacuum breaker, and its location may be altered without altering the scope of the present invention. Operation of AVB 34 and solenoids 36 and 38 is further described hereinbelow.

As shown in FIGS. 1 and 2, a detachable tank cover 40 may be affixed to fixture 12 so as to prohibit access to containment area 32. Although tank cover 40 is not essential to the practice of the present invention, it may be utilized in environments where it is desirable to deter tampering and vandalism. Any number of conventional locking mechanisms may be used which are known in the art and which are amenable to the practice of the present invention.

Referring further to FIG. 2, sidewalls 28 extend along the length of rear wall 14 from ingress 30 and terminate at bowl portion 42. Bowl portion 42 has an outer surface 44 and an inner surface 46 defining a fluid well 48 therewithin. Well 48, together with rear wall 14 and sidewalls 28, defines an interior waste capture portion 50 that receives fluid therewithin and directs fluid to a bottom extent 42*a* of bowl portion 42 so as to protect the user and his environment from backsplash and to direct fluid flow to bottom extent 42*a*. A fluid drain 52 disposed at bottom extent 42*a* reveals a visible trap seal 54 having a predetermined static water level 56. Trap seal 54 is typically a code compliant, non-mechanical trap seal of 2" consistent with typical water consuming urinals. Fluid escapes through drain 52 and traverses a trapway 58 in fluid communication therewith for evacuation through waste conduit 24. A strainer device (not shown) may be disposed in or adjacent drain 52 to retain solids and thereby prevent obstruction of trapway 58.

First and second solenoid valves 36 and 38, respectively, are also disposed in containment area 32 and may be selected from a variety of well-known and commercially available solenoid valves. Valves 36 and 38 are in electrical communication with a sensor 60 that detects the presence and proximity of a urinal user and initiates a dual-phase flush cycle in response thereto. Sensor 60 is desirably an infrared sensor that is well known in the art for touchless operation of fixtures and fittings. Sensor 60 may alternatively comprise radar, laser or other detection means that are amenable to practice of the present invention.

Upon detection of a user, sensor 60 initiates a flush cycle by generating and transmitting a first signal to first solenoid valve 36. Sensor 60 may generate this signal after a predetermined temporal duration, upon detecting a user within a predetermined distance of fixture 12, upon absence of a user after a predetermined time or any other parameter consistent with flushing the urinal after each use. An installer can preprogram and adjust such values for the sensor depending upon the desired parameter.

Upon receipt of the first sensor-generated signal, first solenoid valve 36 discharges water from a discharge port (not shown) that is in fluid communication with bowl portion 42 via channel 16 (which channel particularly extends from the discharge port to trap seal 54). Water travels from valve 36 along channel 16 to remove waste from well 48. This water exchange function removes urine and water from well 48, thereby obtaining a minimum of a 100:1 dilution ratio and replenishing trap seal 54 for subsequent flushes.

At a predetermined interval subsequent to activation of first solenoid valve 36, sensor 60 initiates a second phase of the flush cycle by generating and transmitting a second signal to second solenoid valve 38. Such interval may be temporally based or may implement a counter to determine the number of users required before valve 38 washes urinal surface 14*b*. When such interval occurs, both valves 36 and 38 activate simultaneously to achieve flushing of well 48 and cleansing of urinal surface 14*b*. This allows the invention to achieve maximum water savings while providing adequate cleanliness.

Second solenoid valve 38 also includes a discharge port (not shown) that is in fluid communication with a urinal spreader 62 (shown in FIG. 1). Spreader 62 comprises a plurality of apertures 64 that evenly distribute water across urinal surface 14*b* to ensure such surface remains clean. Sensor 60 desirably does not activate second solenoid valve for every flush effected by first solenoid valve 36. Rather, an installer or maintenance professional advantageously programs sensor 60 to activate valve 38 in accordance with predetermined parameters that accommodate the demands of the installation. For installations where anticipated demand will be consistently high (for example, an airport), second solenoid valve 38 can be programmed to activate every 15 minutes or after every 15 users. For installations where anticipated demand is stable and is limited to certain hours of the day (for example, an office restroom), second solenoid valve 38 can be programmed to activate every other hour during the period of demand and further programmed to refrain from flushing during night hours when no demand is expected.

Figure 3:
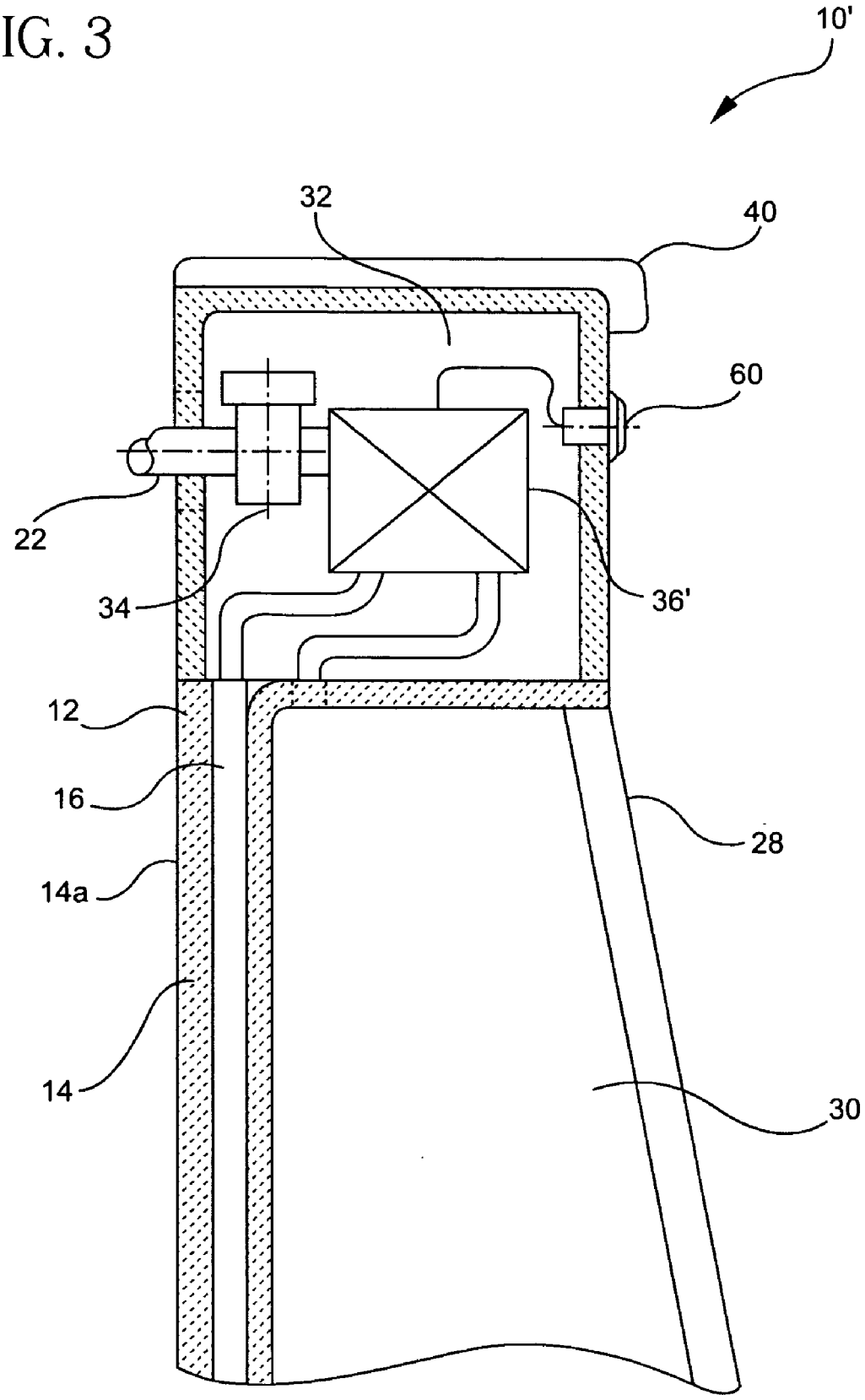
FIG. 3 shows a partial cross-section of an alternative preferred embodiment of the urinal of the present invention.

FIG. 3 shows an alternative embodiment of the dual phase flush urinal of the present invention. Urinal 10' includes all of the features disclosed with reference to urinal 10 described hereinabove, except that containment area 32 accommodates a single solenoid valve 36' instead of first and second solenoid valves 36 and 38, respectively. Solenoid valve 36' has a first discharge port (not shown) in fluid communication with bowl portion 42 via channel 16. Solenoid valve 36' further includes a second discharge port (not shown) in fluid communication with urinal spreader 62. Solenoid valve 36' operates in substantially the same manner as first and second solenoid valves 36 and 38. Upon receipt the first signal generated by sensor 60, solenoid valve 36' discharges water from the first discharge port to initiate the water exchange function. As in urinal 10, sensor 60 can generate this signal after a predetermined temporal duration, upon detecting a user within a predetermined distance of fixture 12, upon absence of a user after a predetermined time or any other parameter consistent with flushing the urinal after each use. At a subsequent predetermined interval, sensor 60 transmits the second signal to solenoid valve 36' to initiate the wall scouring function.

The configuration of the present invention offers significant water conservation advantages. Unlike conventional urinals that effect cleansing with every flush, the present invention attenuates water consumption while maintaining sufficiently sanitary conditions. Although conventional low-water urinals often employ self-contained proximity sensors that are in electrical communication with a single solenoid, such sensors are programmed to simultaneously effect the water exchange function and the wall scouring function after every use. Consequently, such urinals typically require 0.5 to 1 gallons (1.9 to 3.8 L) per flush to operate properly, thereby consuming more water than necessary to sustain a sufficiently clean fixture. The present invention overcomes this deficiency by providing a dual phase flush function that requires only about 0.1 to 0.2 average gallons per flush for the water exchange function, thereby reducing water consumption from about 40% to 80% over even the most efficient urinal designs. Although scouring of the back wall of the fixture reduces odors and maintains a clean appearance, it is not necessary to perform this function on every flush cycle. The water exchange function fully discharges the liquid waste of each user after every cycle and presents the next user with clean water. Therefore, urinals configured as described herein provide for satisfactory urinal cleanliness with minimal water usage.

Various changes to the foregoing described and shown structures are now evident to those skilled in the art. The matter set forth in the foregoing description and accompanying drawings is therefore offered by way of illustration only and not as a limitation. Accordingly, the particularly disclosed scope of the invention is set forth in the following claims.

What is claimed is:

1. A urinal having a dual-phase flush cycle, comprising:

a fixture having a rear wall, said rear wall having a mounting surface and a urinal surface with an elongate channel defined therebetween along a longitudinal extent of said rear wall, coextensive sidewalls protruding normally outwardly from said urinal surface and terminating at a curved bowl portion of said fixture, each sidewall having a generally planar inner surface in parallel alignment with an inner surface of a sidewall spaced therefrom, said urinal surface and said sidewall inner surfaces defining an ingress for an internally defined containment area in which at least one atmospheric vacuum breaker (AVB) and at least one valve means are disposed, said valve means being in electrical communication with a sensor and having a first fluid discharge port in fluid communication with the bowl portion and a second fluid discharge port, wherein, upon detection of the user, said sensor transmits a first signal to said valve means to initiate a first water exchange phase of the flush cycle during which said valve means discharges water through said first fluid discharge port along said elongate channel to remove waste from said bowl portion, and said sensor, after a predetermined delay, transmits a subsequent second signal to said valve means to initiate a wall-scouring phase of the flush cycle during which said valve means discharges water from said second fluid discharge port along said urinal surface.

2. A urinal according to claim 1, wherein said rear wall has an upper extent that accommodates ingress of a pre-existing water supply conduit therein and a lower extent that accommodates egress of a pre-existing waste conduit therefrom.

3. A urinal according to claim 2, wherein said elongate channel extends from said upper extent to said lower extent.

4. A urinal according to claim 2, wherein said lower extent accommodates an outlet adapter in communication with said urinal and said waste conduit.

5. A urinal according to claim 4, wherein said sidewalls extend along the length of said rear wall from said ingress to said bowl portion.

6. A urinal according to claim 1, wherein said urinal surface and said sidewall inner surfaces together delineate an ingress that provides access to said containment area.

7. A urinal according to claim 1, further comprising a tank cover detachably affixed to said fixture so as to prohibit access to said containment area.

8. A urinal according to claim 1, wherein said bowl portion includes inner and outer surfaces defining a fluid well therewithin.

9. A urinal according to claim 8, wherein said fluid well, said rear wall and said sidewalls together define an interior waste capture portion that receives fluid therewithin and directs fluid to a fluid drain disposed in said bowl portion.

10. A urinal according to claim 9, wherein said fluid drain is in fluid communication with said waste conduit via a trapway disposed therebetween.

11. A urinal according to claim 9, wherein a strainer device is disposed in or adjacent said drain.

12. A urinal according to claim 1, further comprising a visible trap seal in said bowl portion, said trap seal having a predetermined static water level.

13. A urinal according to claim 12, wherein said static water level is 2".

14. A urinal according to claim 1, wherein said fixture is fabricated from a material selected from porcelain, ceramic, plastic, and metal.

15. A urinal according to claim 1, wherein said fixture has one or more treatments applied thereon, said treatments selected from coatings or glazes having one or more of hydrophobic, hydrophilic, anti-microbial, antibacterial, biocidal, odor suppressing, anti-viral and algicidal properties.

16. A urinal according to claim 1, wherein said valve means is selected from (1) a pair of first and second solenoid valves with each of said first and second solenoid valves having respective first and second fluid discharge ports provided therewith, and (2) a single solenoid valve having first and second fluid discharge ports provided therewith.

17. A urinal according to claim 1, wherein said sensor intermittently generates and transmits said first and second signals simultaneously in accordance with predetermined parameters such that said second wall scouring phase occurs only when said parameters are met.

18. A urinal according to claim 17, wherein said predetermined parameters are selected from the group of parameters consisting of the passage of a predetermined temporal duration, use of said urinal by a predetermined number of users, absence of users for a predetermined temporal duration and any combination thereof.

19. A urinal according to claim 1, wherein said sensor generates said first signal after fulfillment of a condition selected from the group of conditions consisting of passage of a predetermined temporal duration, detection of said user within a predetermined distance of fixture, detection of the absence of said user after a predetermined temporal duration and any combination thereof.

20. A urinal according to claim 1, wherein said urinal surface includes a urinal spreader comprising a plurality of apertures that evenly distribute water across said urinal surface.

* * * * *